US006573815B1

(12) United States Patent
Tsukima et al.

(10) Patent No.: US 6,573,815 B1
(45) Date of Patent: Jun. 3, 2003

(54) CIRCUIT BREAKER

(75) Inventors: Mitsuru Tsukima, Tokyo (JP); Takao Mitsuhashi, Tokyo (JP); Masahiro Fushimi, Tokyo (JP); Shinji Yamagata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/890,234

(22) PCT Filed: Jun. 30, 2000

(86) PCT No.: PCT/JP00/04363

§ 371 (c)(1),
(2), (4) Date: Sep. 27, 2001

(87) PCT Pub. No.: WO01/41168

PCT Pub. Date: Jun. 7, 2001

(30) Foreign Application Priority Data

Dec. 2, 1999 (JP) ..... 11-343269

(51) Int. Cl.[7] ..... H01H 13/04

(52) U.S. Cl. ..... 335/202; 335/16; 335/132; 218/22

(58) Field of Search ..... 335/201, 202, 335/16, 147, 195; 218/34, 35, 36–41, 155, 156, 157, 22

(56) References Cited

U.S. PATENT DOCUMENTS 3,177,325 A * 4/1965 Pokorny ..... 335/16
4,453,053 A * 6/1984 Yamagata et al. ..... 218/22
4,581,511 A 4/1986 Leone
4,780,579 A * 10/1988 Asahi et al. ..... 218/156
5,281,776 A * 1/1994 Morel et al. ..... 335/16
6,373,014 B1 4/2002 Mitsuhashi et al.

FOREIGN PATENT DOCUMENTS

| | | | |
|---|---|---|---|
| EP | 0 028 013 | 5/1981 | |
| EP | 0273503 | * 7/1988 | ..... 218/156 |
| JP | 1-26139 | 3/1982 | |
| JP | 4-71133 Y | 3/1992 | |
| JP | 8-273513 | 10/1996 | |
| JP | 9-115410 X | 5/1997 | |
| JP | 10-334785 | 12/1998 | |

* cited by examiner

*Primary Examiner*—Lincoln Donovan
(74) *Attorney, Agent, or Firm*—Leydig, Voit & Mayer, Ltd.

(57) ABSTRACT

The circuit breaker includes a stationary contact member having a stationary contact, a movable contact member having at one end a movable contact contacting and separating from the stationary contact and having at the other end a rotational center, a case surrounding the stationary contact and the movable contact and defining a pressure accumulating space at one side of an arc generation position at which an electric arc is generated for temporarily storing a pressurized gas pressurized by the arc generated between the stationary and the movable contact upon a current interruption, and an exhaust port disposed at the other end of the arc generation position in the case so that the pressurized gas stored within the accumulation space upon the current interruption is exhausted by passing between the stationary contact and the movable contact.

7 Claims, 13 Drawing Sheets

CIRCUIT BREAKER

TECHNICAL FIELD

This invention relates to a circuit breaker in which the circuit breaking is achieved by separating a movable contact of a rotatable movable contact member from a stationary contact of a stationary contact member.

BACKGROUND ART

While circuit connecting or breaking is achieved in a circuit breaker by contacting and separating a movable contact of a movable contact member with respect to a stationary contact of a stationary contact member, an electric arc is generated between the separated movable contact and the stationary contact during the circuit breaking because of a voltage applied to the circuit. Therefore, in the circuit breaking operation, how quickly the arc can be extinguished is an important concern. In a conventional circuit breaker in which the movable contact and the stationary contact are brought into contact or separated by rotating the movable contact member, arc extinguisher plates are disposed in the vicinity of the arc generating position in order to extinguish the arc.

FIGS. 16*a* and 16*b* are views showing the conventional circuit breaker arrangement in which the movable contact member is rotated for circuit interruption, FIG. 16*a* being a perspective view and FIG. 16*b* being a cross sectional view taken along the line XVIb—XVIb of FIG. 16*a* and in a plane perpendicular to the bottom surface of the circuit interrupter. In these figures, 101 is a vessel, 102 is a cover placed over the vessel 101. The cover 102 does not retain a high pressure within the cover so that the inner gas is permitted to flow outside.

103 is a movable contact member rotatably attached to a mechanism unit 107 and has a movable contact 103*a*, 104 is a stationary contact member secured to the vessel 101 and has a stationary contact 104*a* capable of being contacted by and separated from the movable contact 103*a*, 105*a* and 105*b* are terminals of the stationary contact member 104, 106 are arc extinguishing plates disposed in the vicinity of the arc generating area and 107 is the mechanism unit for rotating the movable contact member 101, which mechanism portion includes a handle 107*a* for manual operation. 108 is an exhaust port formed in the cover 102 and 109 is a relay unit for detecting an abnormal current and causes the operation of the mechanism unit 107.

In the conventional circuit breaker as above described, as shown in FIGS. 16*a* and 16*b*, the electrical connection between the movable contact 103*a* and the stationary contact 104*a* are established by being brought into contact with each other, so that an electric current flows through the respective terminals 105*a* and 105*b*.

On the other hand, in order to interrupt the electric current flowing through the terminals 105*a* and 105*b*, the mechanism unit 107 is operated by the manual operation through the handle 107*a* or by an automatic operation caused by a current higher than the rated current, whereby the operating mechanism unit 107 is operated to rotate the movable contact member 103 to cause the movable contact 103*a* to separate from the stationary contact 104*a*. At this time, an electric arc is generated between the movable contact 103*a* and the stationary contact 104*a*. This arc is elongated by rotational motion of the movable contact member 103 an electromagnetic force generated by the current flowing between the movable contact member 103 and the stationary contact member 104 and, thereafter, the arc is divided and quenched by the arc extinguisher plates 106 extinguished. After this, the movable contact member 103 is held in an open state in which it is separated from the stationary contact 104.

During the interruption in the conventional circuit breaker, the arc is elongated by the rotational motion of the movable contact member 103 and this elongated arc is divided and quenched by the arc extinguisher plates 106, so that the interrupting capability is limited by the number of the arc extinguisher plates 106 and the maximum separation distance of the movable contact member 103 or the size of the arc extinguishing chamber.

Also, although an exhaust port 108 is provided at one side within the arc extinguishing chamber in order to exhaust pressurized arc gas generated upon the arc occurrence, since the conventional circuit breaker does not have sufficient gas-tightness of the vessel, the pressurized arc gas (hereinafter referred to as pressurized gas) is exhausted without being utilized in arc extinction through the spaces defined in the mechanism unit and between the relay unit, the vessel, the cover and the like.

Further, while the arc gas contains gases that are effective for the arc extinction, they are not effectively utilized and the arc extinguishing capability is subjected to limitation by the number of the arc extinguishing plates 106 and the maximum separation distance of the movable contact member 103 or the volume of the arc extinguishing chamber.

The present invention has been made to solve the above problem and has as its object the provision of a compact circuit breaker of a high arc extinguishing capability by utilizing a pressurized gas generated upon the arc occurrence.

Another object is to provide a compact circuit breaker of a high arc extinguishing capability by generating and utilizing a gas effective for arc extinction generated upon the arc occurrence and utilizing.

DISCLOSURE OF INVENTION

The circuit breaker according to the present invention comprises a stationary contact member having a stationary contact, a movable contact member having at one end a movable contact capable of contacting with and separating from the stationary contact and having at the other end a rotational center, an arc extinguisher chamber vessel surrounding the stationary contact and the movable contact and defining a pressure accumulating space at one side of an arc generation position at which an electric arc is generated for temporarily storing a pressurized gas pressurized by the arc generated between the stationary and the movable contact upon the current interruption, a main body case including at least one of the arc extinguisher chamber, and an exhaust port disposed at the other end of the arc generation position in the arc extinguisher chamber and the main body case so that the pressurized gas stored within the accumulation space upon the current interruption is exhausted between arc spots formed on the stationary contact and the movable contact.

Also, the arc extinguisher chamber vessel may be constructed in a hexahedron and may have a length c in the direction perpendicular to the plane of rotation of the movable contact, a length b in the direction of initial separation of the movable contact, a length a perpendicular to the b and the c, and may be arranged such that a relation ship a>b>c holds.

Also, of two spaces defined by dividing a space within the arc extinguisher chamber by a plane passing through the centers of the arc spots formed on the movable contact member and the stationary contact member and perpendicular to a plane of rotational movement of the movable contact member, volume of the space provided with the exhaust port may be arranged to be smaller than the volume of the other space.

Also, the exhaust port may be located in the vicinity of the stationary contact or the movable contact upon separation.

Also, a conductor portion for holding the movable contact member may be disposed within the arc extinguisher compartment so that the movable contact member is rotatable and the pressure accumulation space is defined in the vicinity of the conductor portion.

Also, a flow cross-sectional area for the pressurized gas at the position between the stationary contact and the movable contact in a flow path between the stationary contact and the movable contact from the pressure accumulation space may be made smaller than a flow cross-sectional area for the pressurized gas at the position upstream of the flow cross-sectional area between the stationary contact and the movable contact.

Also, a sidewall of the arc extinguisher compartment vessel in the vicinity of the arc generating position is provided with a chamber having an opening portion in the direction of the arc.

Also, the arc extinguisher chamber vessel may be made of an organic insulating material.

Also, an organic insulating material may be disposed in the vicinity of the arc generating position within the arc extinguishing chamber vessel.

Further, an exhaust port may be provided in the vicinity of at one of the stationary contact or the movable contact upon separation and the organic insulator may be provided in the vicinity of the other of the stationary or movable contact upon separation.

Also, an electrode for the commutation of either one of the arc spots may be disposed in the vicinity of the stationary contact of the stationary contact member or the movable contact of the movable contact member, and the direction of normal of the plane to which the arc spot commutates may be more closely directed toward the exhaust port than is the direction of normal of the plane of the contacting surface of the movable contact or the stationary contact.

Also, a fine opening of the arc extinguisher chamber vessel except for the exhaust port may be closed by a separate member engaged thereto.

BEST MODE FOR CARRYING OUT THE INVENTION

Embodiment 1

Figure 1:
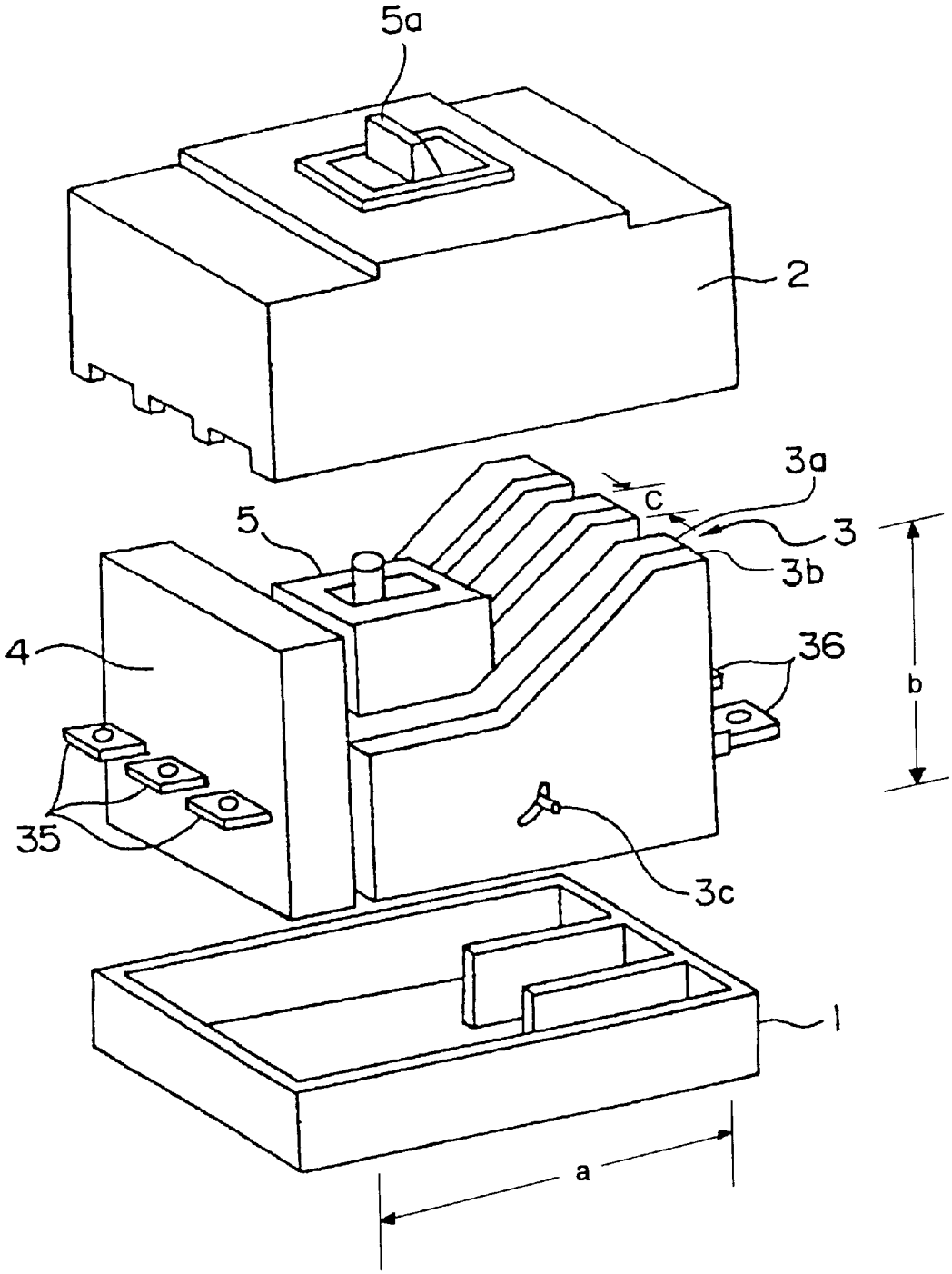
FIG. 1 is an exploded perspective view showing the circuit breaker of the first embodiment of the present invention.

FIG. 1 is an exploded perspective view showing the circuit breaker according to the first embodiment of the present invention. In the figure, 1 is a base for housing an arc extinguisher unit 3 or the like, 2 is a cover fitted over the base 1, 3 is a vessel for housing an arc extinguisher such as a stationary contact and a movable contact (hereinafter referred to as an arc extinguisher unit), which arc extinguisher unit 3 comprises a left-hand part 3*a* and a right-hand part 3*b*. The arc extinguisher unit 3 is arranged in highly hermetic so that the pressurized gas generated upon the current interruption may be temporarily stored within the pressure accumulation space defined within the arc extinguisher unit 3.

4 is a relay unit for detecting an abnormal current and activating a mechanism unit 5, 5 is the operating mechanism unit for opening and closing the contacts through the cross bar 3*c* and having a handle 5*a* for manual operation. When the circuit breaker is composed by unitizing the respective components as above described and combining the units, the assembly is easy and the reduction of cost can be realized.

Also, by housing the arc extinguisher within the arc extinguisher unit 3, the pressure increase within the circuit breaker during the interruption is not directly received by the base 1 and the cover 2. Therefore, while the base and the cover according to the conventional design have been made of a mechanically strong, expensive molding material, by providing the arc extinguisher unit 3 within the casing, the amount of the material for the casing subjected to pressure can be decreased, thus realizing the cost reduction.

Also, since the arc extinguisher is enclosed by the arc extinguisher unit, the high-temperature gas upon the interruption does not contact with the relay portion, the operational reliability of the relay is increased. Also, it is difficult for the high-temperature gas including the metallic vapor to intrude into another pole unit, so that the deterioration of the inter-phase insulation after the interruption can be suppressed.

Figure 2:
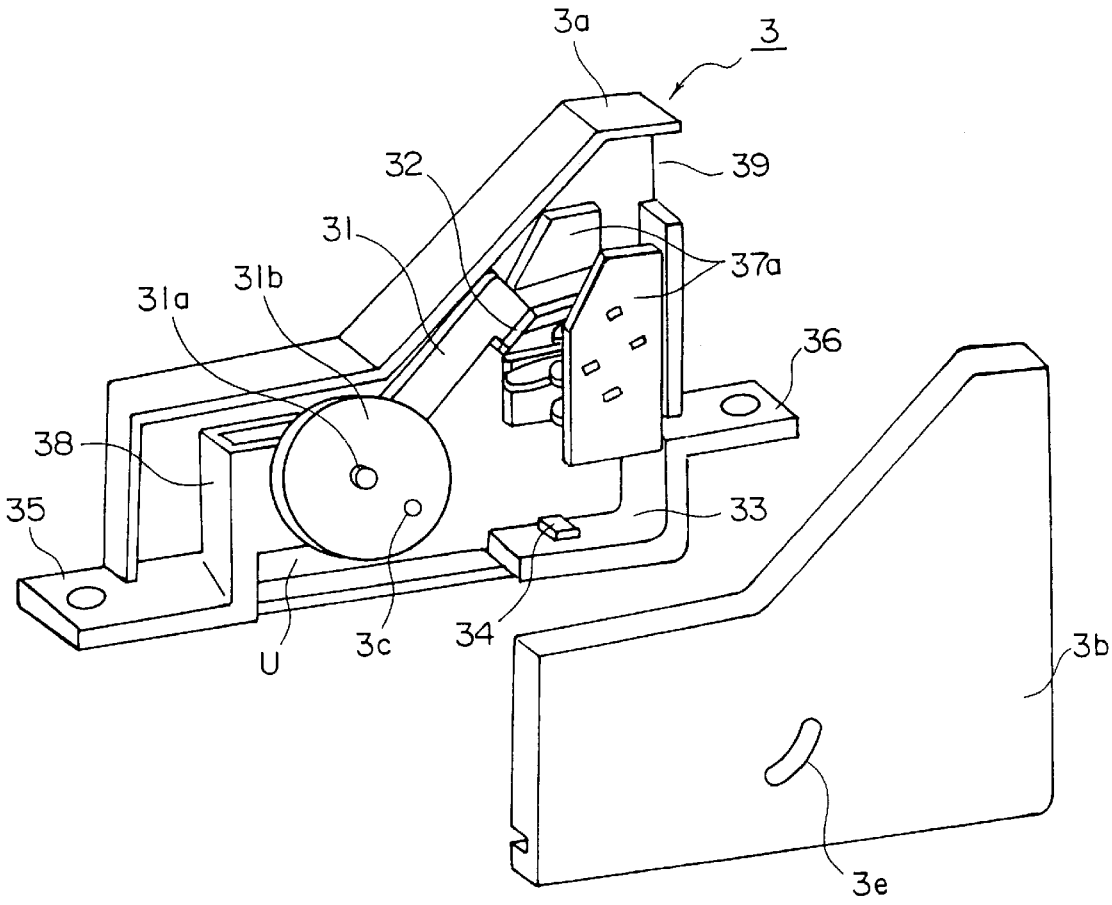
FIG. 2 is an exploded perspective view showing the arc extinguisher unit shown in FIG. 1.
Figure 3A:
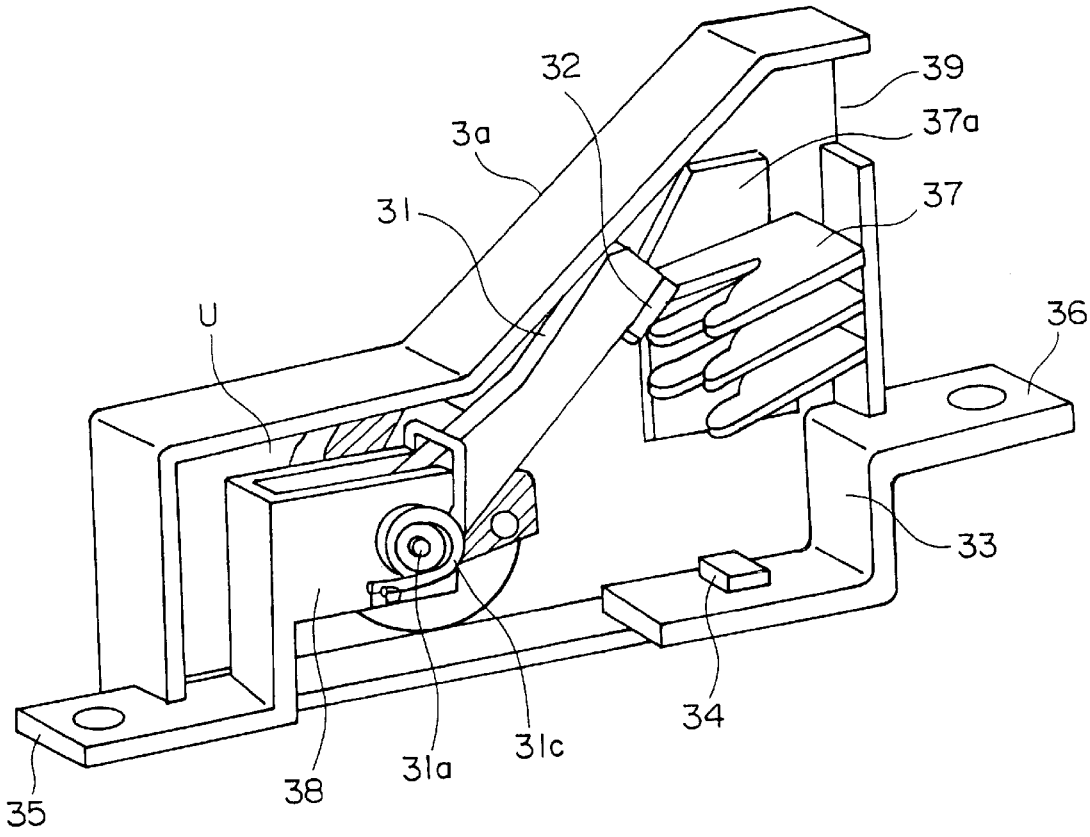
FIG. 3*a* is an exploded perspective view schematically showing the arc extinguisher unit shown in FIG. 2.

FIG. 2 is an exploded perspective view showing the arc extinguisher unit shown in FIG. 1, and FIG. 3*a* is an exploded perspective view showing the arc extinguisher unit shown in FIG. 2 with the right-hand pat 3*b* of the arc extinguisher as well as the rotor omitted. In the figure, 31 is a movable contact member rotatably mounted at one end to the holding conductor 38 and rotatable about the rotational center 31*a*, 31*b* is a rotor for transmitting the rotational movement through the mechanism unit 5 and the cross bar 3*c*, and 31*c* is a contact pressure spring.

32 is a movable contact secured to the other end of the movable contact member 31, 33 is a stationary contact secured by two parts 3*a* and 3*b* of the arc extinguisher unit, and 34 is a stationary contact secured to the stationary contact member 33, the stationary contact being arranged to be brought into contact with or separated from the movable contact 32 by the rotation of the movable contact member 31. When closed, the movable contact 32 of the movable contact member 31 is in the clockwisely urged state as illustrated in the figure by the contact spring 31*c*.

35 is a terminal portions of the holding conductor 38 electrically connected to the movable contact member 31, 36 is a terminal portion on the opposite side of the stationary contact 34 of the stationary contact member 33 and 37 are arc extinguisher plates, which are secured to arc extinguisher side plates 37*a*. 38 is a holding conductor for rotatably supporting the movable contact member 31, 39 is an exhaust port provided in the housing main body 3*a* of the arc extinguisher unit 37, the position of the exhaust port 39 is in the vicinity of the movable contact in the open position as illustrated in the figure.

The arc extinguisher unit 3 is arranged in a substantially sealed state except for the exhaust port 39 so that the internal gas (pressurized gas) does not easily leak, whereby a pressure accumulating space U for temporarily storing therein the pressurized gas pressurized by an electric arc generated between the separated contacts upon the current interruption is defined on one side of the position at which the arc generates. More particularly, the pressure accumulating space U is defined in the vicinity of the rotational center 31 a of the movable contact member 31 (around the holding conductor 38) within the arc extinguisher unit 3.

Figure 3B:
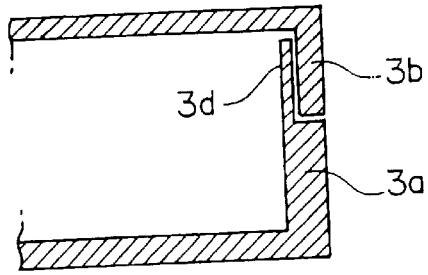
FIG. 3*b* is an exploded perspective view showing the fitting surfaces of the arc extinguisher unit shown in FIG. 2.

Since two parts 3*a* and 3*b* of the arc extinguisher unit 3 are firmly connected by screws, rivets, bonding agent or the like, so that the seal of the arc extinguisher unit 3 can be maintained at a high level. Also, the mating surfaces of the base 1 and the cover 2 as well as the mating surfaces between the parts 3*a* and 3*b* of the arc extinguisher unit 3 are arranged in substantially vertical, so that the amount of the leakage of the gas from the mating surfaces can be further limited. Further, as shown in FIG. 3*b*, the mating surfaces of the arc extinguisher unit 3 is provided at their vicinity with overlapping portions 3*d*, so that, even when the mating surfaces are slightly parted due to the pressure increase within the arc extinguisher unit 3, the gas leakage is suppressed. For the simplicity of the illustration, these overlapping portions are not illustrated in except in FIG. 3*b*.

Figure 3C:
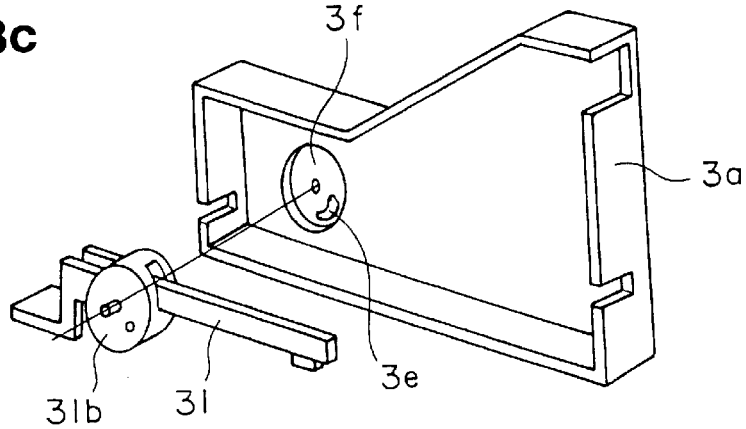
FIG. 3*c* is an exploded perspective view showing the movable contact member and a portion of the arc extinguisher unit shown in FIG. 2.

FIG. 3*c* is a perspective view showing only the left-hand part 3*a* of the arc extinguisher unit 3 and the movable contact member 31. The arc extinguisher unit 3 is provided with a U-shaped groove 3*e* through which the cross bar 3*c* extends and displaces therein. On the other hand, a circular recessed portion 3*f* is provided inside of the arc extinguisher unit and a rotor 31*b* is disposed in substantially intimate contact with the arc extinguisher unit 3 when it is assembled into the arc extinguisher unit 3, so that the amount of the gas leakage through the U-shaped groove 3*e* is suppressed.

Figure 3D:
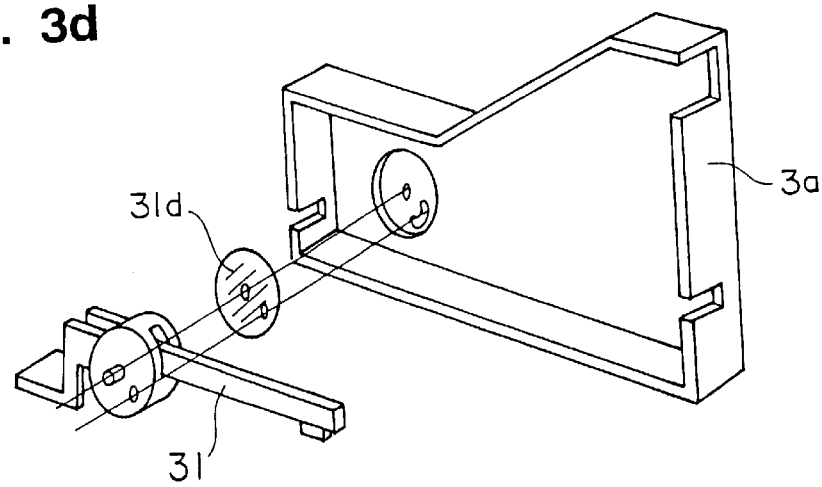
FIG. 3*d* is an exploded perspective view showing the fitting surfaces of the arc extinguisher unit shown in FIG. 2.

Also, as shown in FIG. 3*d*, a flexible thin plate 31*d* is disposed between the rotor 31*b* and the arc extinguisher unit 3 so that the rotor 31*b* may be smoothly rotated and that the U-shaped groove 3*e* may be closed by the pressure difference relative to the outside of the arc extinguisher unit 3, whereby the gas-tightness of the arc extinguisher unit 3 can be further increased.

Also, as for the material for the arc extinguisher unit 3, an organic insulating material such as plastic materials can be advantageously employed so that a gas of a high interrupting capability can be generated by the arc generated between the movable contact 32 and the stationary contact 34 upon the current interruption.

Figure 4:
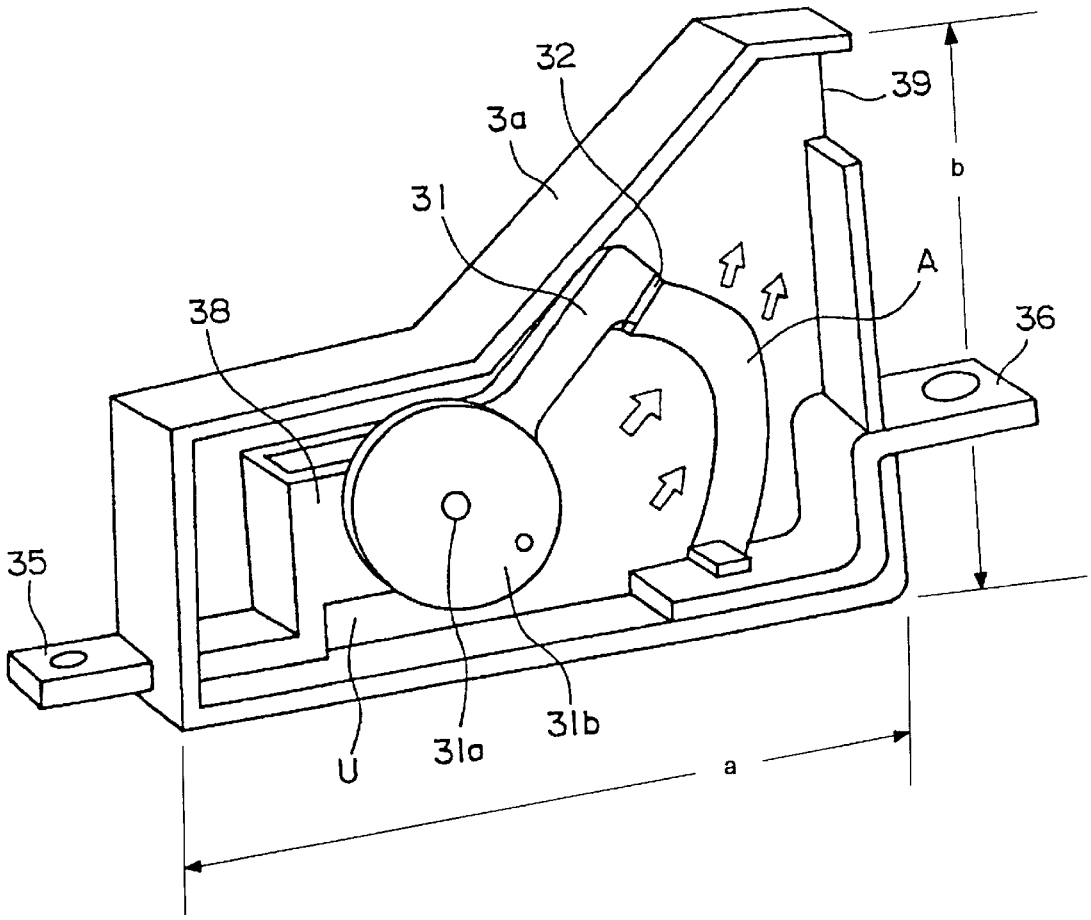
FIG. 4 is a view showing the circuit breaker shown in FIG. 1 upon the current interruption.

The operation will now be described. FIG. 4 is a view showing the circuit breaker shown in FIG. 1 in the current interrupting. For the simplicity of explanation, the explanation of the arc extinguisher plates 37 and the arc extinguisher side plates 37*a* are omitted.

The usual opening and closing operation is achieved by manually operating the handle 5*a*. This handle operation causes the rotor 31*b* to rotate through the mechanism unit 5 and the cross bar 3*c* to move the movable contact members 31. Also, when a large current such as a short-circuiting current flows, the electromagnetic repulsive force between the movable contact and the stationary contact as well as the electromagnetic repulsive force between the movable contact 31 and the stationary contact 34 cause the movable contact member 31 to rotate without waiting for the operation of the operating unit 5 to generate an electric arc A. The heat from the arc A increases the temperature of the gas therearound, so that the pressure of the gas therearound increases.

The pressurized gas thus pressurized is, on the side of the exhaust port 39, discharged directly via the exhaust port 39 and becomes, on the side of the pressure accumulating space U which is opposite to the exhaust port 39, as a concentrated strong gas flow from the pressure accumulating space U toward the exhaust port 39 after it is temporarily stored in the pressure accumulating space U. This gas flow is discharged from the exhaust port 39 after flowing through the space defined between the movable contact 32 and the stationary contact 33 positioned between the pressure accumulating space U and the exhaust port 39. That is, the blow of the pressurized gas is puffed in the transverse direction to the arc A generated between the movable contact 32 and the stationary contact 33. As a result, the arc is quenched by the strong blast of the gas flow and the electrical insulation between the electrodes is recovered, resulting in the arc extinction.

Further, since the arc extinguisher unit 3 is made of an organic insulating member, this organic insulator is light abraded by the light radiated from the arc A or contacted by the high temperature gas, so that a decomposition gas which highly contributes to the pressure increase and has a low electric conductivity is generated. Therefore, the pressure within the pressure accumulating space U increases as the decomposition gas generates, allowing a stronger gas flow to generate. Also, since this decomposition gas has a low electric conductivity, a superior interruption capability can be achieved.

Further, since the arc A is bent to the right as illustrated in FIG. 4, by arranging the arc extinguisher plates 37 at a position close to the movable contact during the separation, the arc quenching function of the arc extinguisher plates 37 can be further improved and the arc interrupting capability can be further improved.

Figure 5:
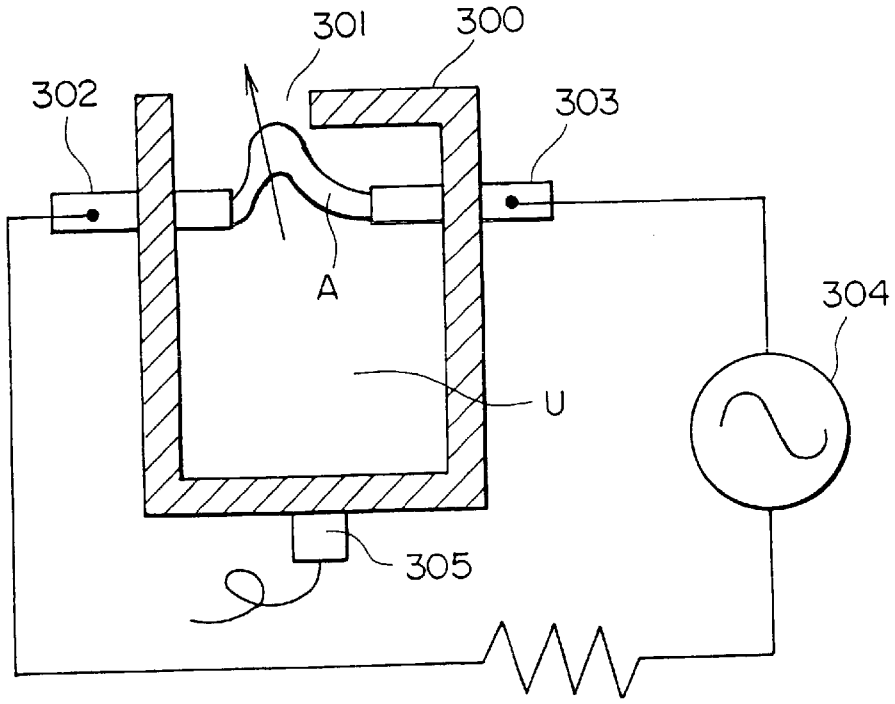
FIG. 5 is a view showing the arrangement schematically showing the circuit breaker.

The results of the basic experiments with the simulated arc extinguisher unit will be explained below. As shown in FIG. 5(*a*), a plastic vessel 300 made after the arc extinguisher unit of a circuit breaker was prepared, copper electrodes 302 and 303 in simulation of the movable contact and the stationary contact were provided on the side of the exhaust port 301 of the vessel and an ac current was supplied between the electrodes 302 and 303 from an ac source 304. In order to measure the pressure within the pressure accumulation space U upon the arc generation, a pressure sensor 305 is disposed at the bottom portion (opposite to the exhaust port 301) of the vessel 300. The vessel 300 is hermetically sealed except for the single exhaust port 301. In this experiments, the distance between the copper electrodes 302 and 303 was set at 20 mm, ac voltage of the ac source 304 was 600 V, ac current was 60 Hz and the peak current value was set at 8.5 kA.

Figure 6:
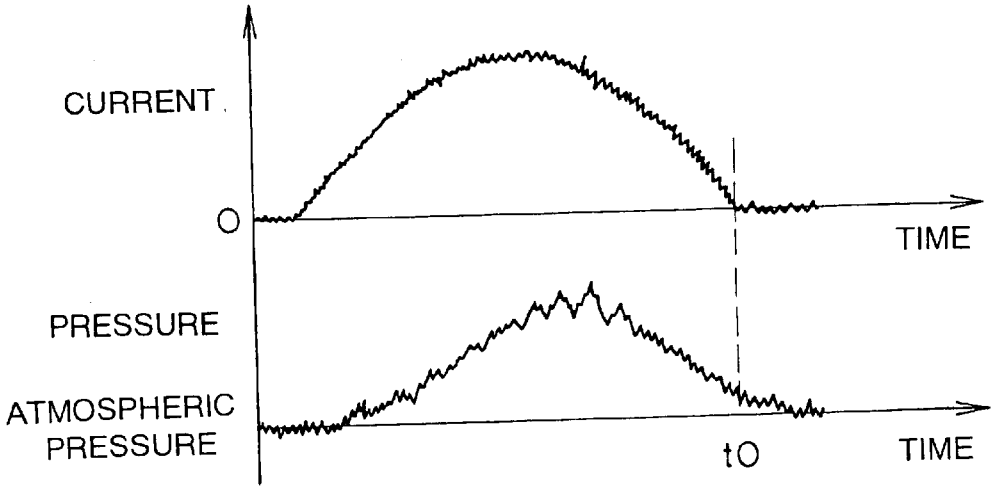
FIG. 6 is a graph showing the current and the pressure as plotted against time according to an experiment.

FIG. 6 shows graphs showing the current and the pressure plotted against time obtained by the experiment under the above conditions. As seen from the graphs, the pressure within the pressure accumulating space U of the vessel 300 after the increase and until the current is interrupted, the pressure within the pressure accumulating space U is higher than the atmospheric pressure. That is, a gas flow (shown by arrows) from the pressure accumulating space U toward the exhaust port 301 until the current is interrupted.

In addition to the above experiments, other experiments was conducted in which the vessel is removed and in which an additional exhaust port is provided on the side of the pressure accumulating space U of the vessel, and the obtained results were that the gas flow acting on the arc was lost or reduced.

Further, when the exhaust port is made excessively large, the pressure increase is not sufficient and it was not possible to obtain a sufficiently strong gas flow. A good result was obtained when the exhaust port is made about or less than a half.

Figure 7A:
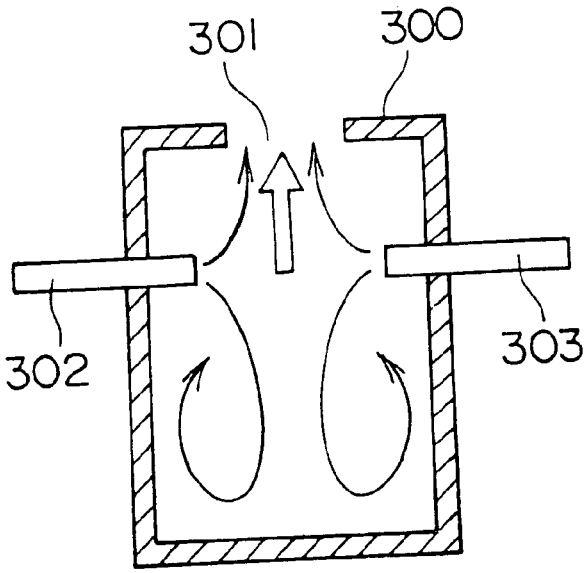
FIG. 7*a* is a view showing the flow of the metallic vapor.
Figure 7B:
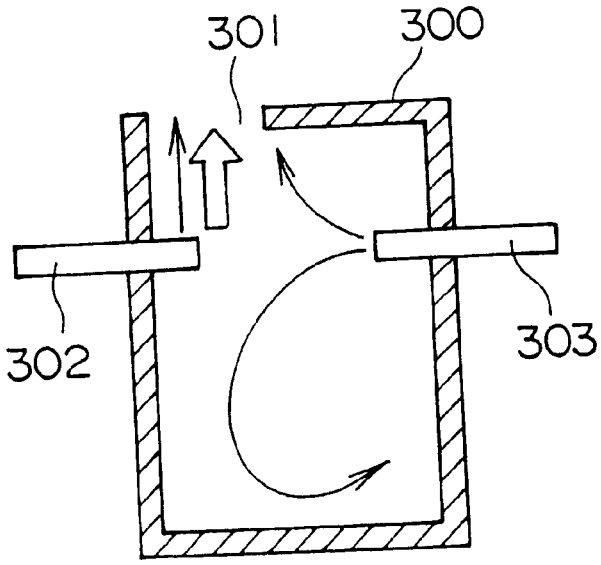
FIG. 7*b* is a view showing the flow of the metallic vapor when the position of the exhaust port is changed.

Also, in addition to the above experiments, an experiment was conducted also on the case in which the position of the exhaust port. FIGS. 7*a* and 7*b* are views showing the flows of the metallic vapor within the arc extinguishing unit when the position of the exhaust port 301 was changed, FIG. 7*a* being a view when the exhaust port is positioned at the central portion and FIG. 7*b* being a view when the exhaust port is displaced from the center to one side.

When the exhaust port 301 is at the center, the flows of the metallic vapor emitted from the electrode 302 and 303 are substantially in symmetry as shown in FIG. 7*a*, and the vapor flows from the electrodes 302 and 303 and define a collision surface at the center and are exhausted by the gas flow. However, some portion of the vapor flow circulates in two regions within the vessel 300. Contrary to this, when the exhaust port 301 is at a shifted position, the flows within the vessel 300 are asymmetrical as shown in FIG. 7*b*.

That is, the flows of the metallic vapor emitted from the electrode 302 on the side close to the exhaust port 301 is exhausted by the gas flow at substantial portion and only some portion of the metallic vapor emitted from the other electrode 303 circulates within a large region in the vessel 300. Therefore, with the exhaust port 301 centrally disposed, the metallic vapor is efficiently mixed within a short time with the gas in the pressure accumulating space U and the interruption capability is degraded. That is, the asymmetrical flow, with which the metallic vapor is less easily mixed with the gas, provides a higher interrupting capability.

Also, with the gas flow concentrated around the electrode, the commutation of the arc spots is easier and the direction of emission of the metallic vapor can be easily directed toward the exhaust port, improving the interruption capability.

Further, the experiments were also conducted as the cases where the volume of the vessel 300 lower than the electrodes 302 and 303 (the pressure accumulating space) are changed. According to the experiments the gas is less easily accumulated within the vessel with a smaller accumulating volume and flows out at an early timing (the pressure within the vessel decreases at an early stage), thus decreasing the interrupting capability. On the contrary, if the volume is too large, the internal pressure does not increase high thus degrading the interruption capability. Therefore, there is an ideal volume in which the interrupting capability can be made maximum. However, when considering the practical size of the breakers, the volume of the arc extinguisher compartment is sufficiently smaller than the size of the ideal value, therefore it can be said that the larger the volume of the arc extinguisher chamber the higher the interrupting capability.

In this embodiment, the pressurized gas pressurized by the arc generated upon the current interruption is temporarily stored within the pressure accumulating space defined by the double vessel, this stored gas within the pressure accumulating space is exhausted through the exhaust port after passed between the arc spots formed on the movable and stationary contact member, so that a sufficient pressurized gas can be blasted at the arc, resulting in a circuit breaker that is compact and high in the interrupting capability.

Also, since the arc extinguisher unit is made of an organic insulating material, a pressurized gas of a high interrupting capability can be generated, so that the gas pressure can be increased and the arc interrupting capability can be improved by the pressurized gas of a high interrupting performance.

Also, since the exhaust port is displaced from the central position (in the vicinity of the stationary contact or the opened movable contact, for example), the flows of the pressurized gas within the arc extinguisher unit can be made asymmetric to further improve the interrupting capability.

Also, since the arc extinguisher unit is constructed substantially hermetic except for the exhaust port by sealing small openings by the overlapping portions or separate members, a strong gas flow can be maintained until the arc extinguishes, whereby a circuit breaker of a high interrupting capability can be obtained.

Also, the arc extinguisher unit is substantially hexahedron and the length dimension perpendicular to the plane of rotation of the movable contact member is the smallest, so that much of the gas flow can be efficiently utilized to act on the arc to obtain a circuit breaker having a high interrupting capability.

Also, the arc extinguisher unit is arranged such that the length dimension in the direction connecting the terminals is the largest, so that a sufficiently large pressure accumulating space can be maintained to realize a high interrupting capability.

Further, by making the length of the movable contact member of the arc extinguisher unit in the direction of initial separation the minimum length that can accommodate the stationary contact and the movable contact most remotely separated from each other, the gas flow flowing through a flow path other than that through the arc can be minimized, resulting in an efficient action of the gas flow on the arc.

Also, in the arc extinguisher unit 3, the volume on the side of the exhaust port as viewed from the arc A is small as compared to the volume on the opposite side to obtain a large pressure accumulating space, so that a sufficiently large pressure accumulating space can be ensured and the interruption capability can be further improved.

Also, while a flexible conductor, which is used for electrically connecting the movable contact member and the relay portion, occupies the above mentioned pressure accumulating space in many wiring breakers, the movable contact member in the embodiment of the present invention is held by the holding conductor, so that a large pressure accumulating space can be maintained, realizing a circuit breaker of a high interrupting capability.

Embodiment 2

While the arc extinction was achieved mainly by a blow of a gas flow in the fist embodiment, this second embodiment utilizes a blow of gas strengthened by an electromagnetic force to extinguish the arc.

Figure 8:
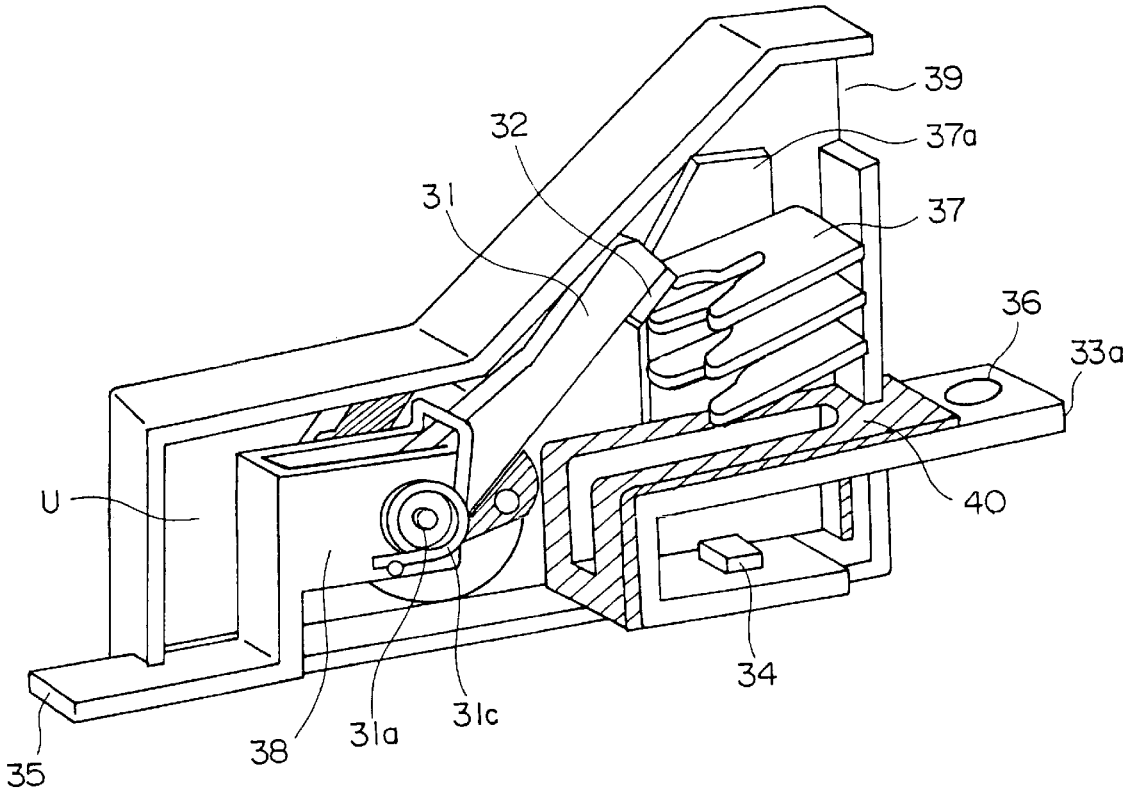
FIG. 8 is an exploded perspective view showing the arc extinguisher unit of the circuit breaker according to the second embodiment of the present invention.
Figure 10:
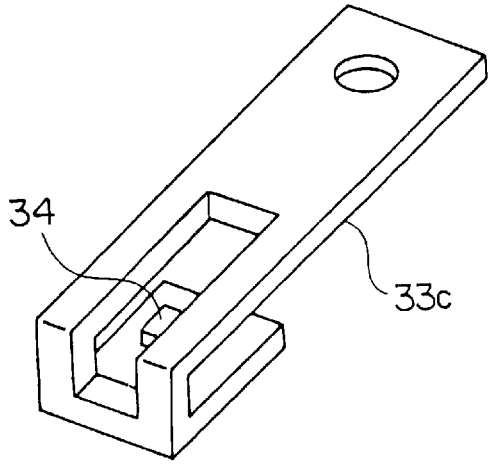
FIG. 10 is a perspective view showing another example of the stationary contact member of the second embodiment of the present invention.

FIG. 8 is an exploded perspective view showing the arc extinguisher unit of the circuit breaker according to the second embodiment of the present invention and is an exploded perspective view with the right hand part of the arc extinguisher unit, one of the arc extinguisher side plates and rotor omitted. In the figure, 33*a* is an inverted U-shaped stationary contact member (Japanese Patent Laid-Open No. 3-32031) in which the blow by the electromagnetic force upon the current interruption is strengthened and 40 is an insulating member attached to the stationary contact member 33*a*. The inverted U-shaped stationary contact member alone is illustrated in FIG. 10 in perspective. In other respects, the structure is similar to the first embodiment, so that its explanation is omitted. The explanation of the operation will be omitted because it is similar to that of the first embodiment except that the gas blow is strengthened by the electromagnetic force around the stationary contact member 33*a* upon the current interruption.

Figure 9:
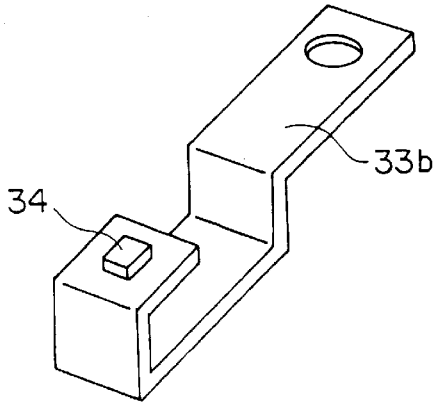
FIG. 9 is a perspective view showing one example of the stationary contact member of the second embodiment of the present invention.
Figure 11:
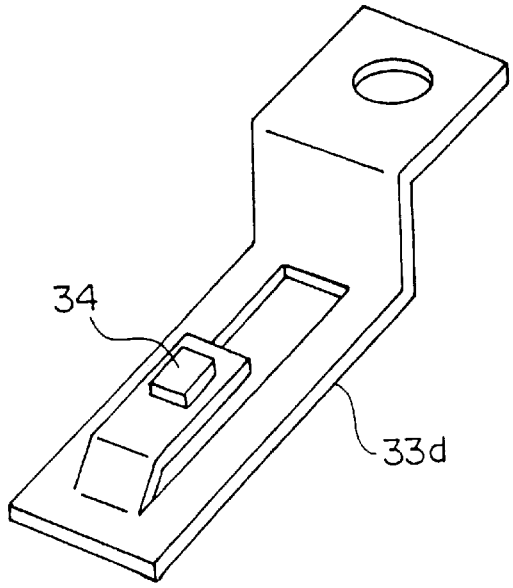
FIG. 11 is a perspective view showing another example of the stationary contact member of the second embodiment of the present invention.

Also, in addition to the configuration of the stationary contact member shown in FIG. 8, the U-shaped stationary contact member 33*b* as shown in FIG. 9 or the stationary contact 2 as shown in FIG. 11 and disclosed in Japanese Utility Model Laid-Open No. 55-96548 may be used to obtain a circuit breaker of a still improved interrupting capability because the arc is subjected to the gas blow due to the electromagnetic force in addition to the gas blow similar to the flow in FIG. 8.

Embodiment 3

In the first embodiment, the flow path area for the pressurized gas at a position between the stationary contact and the movable contact in the flow path passing through the space between the stationary contact and the movable contact is made equal to the flow path area for the pressurized gas at a position upstream of a space between the stationary and movable contact. In contrast, in this third embodiment, the flow path area for the pressurized gas at a position between the stationary contact and the movable contact is made smaller than the flow path area for the pressurized gas at a position upstream of the space between the stationary contact and the movable contact.

Figure 12A:
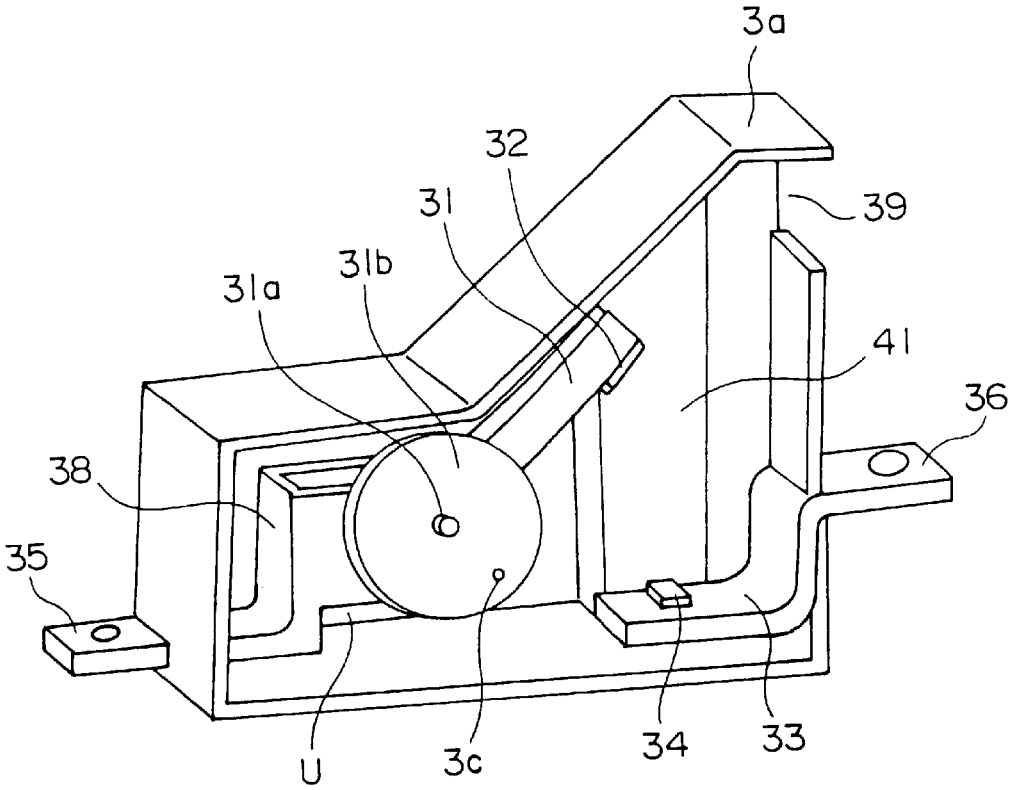
FIG. 12*a* is a perspective view showing the arc extinguisher unit of the circuit interrupter of the third embodiment of the present invention.
Figure 12B:
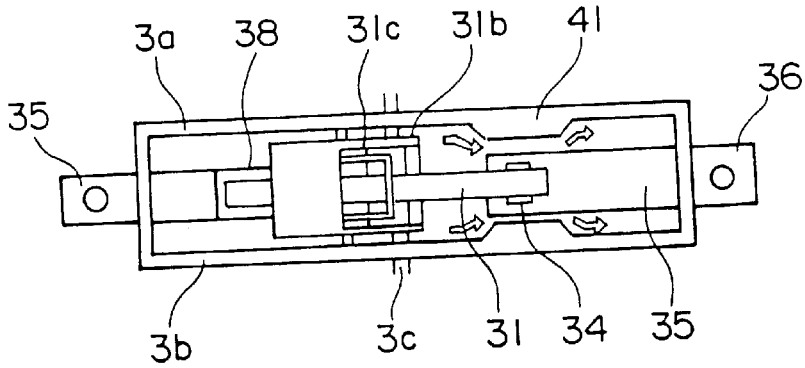
FIG. 12*b* is a schematic sectional plan view of the arc extinguisher unit shown in FIG. 12*a*.

FIGS. 12*a* and 12*b* are views showing the arc extinguisher unit of the circuit breaker of the third embodiment, FIG. 12*a* being an exploded perspective view from which the arc extinguisher plates, arc extinguisher side plates and the arc extinguisher unit housing cover are omitted and FIG. 12*b* being a sectional top view of the arc extinguisher unit. In the figure, 41 are a thick portion in which the thickness of the sidewall of the arc extinguisher unit 3 in the vicinity of the arc-generating region is increased. The arrows in FIG. 12*b* depict the direction of flow of the pressurized gas. In other respects this embodiment is similar to the first embodiment, so that their explanations will be omitted.

Since the flow speed within the arc extinguisher unit 3 upon the high current interruption is at a level of sound speed, the gas flow that is blasted to the arc can be made further stronger by arranging the configuration within the arc extinguisher unit 3 narrower in the vicinity of the arc generation position (the nozzle effect). Therefore, the circuit breaker can be made to have a superior interruption capability.

While the arc flow area through which the gas flow passes in the vicinity of the arc is made smaller by making the thickness of the side walls large in this embodiment, the arrangement is not limited to this particular configuration, but a portion of the side wall in the vicinity of the arc may be deflected toward inside or a separate member may be additionally attached to the inner surface of the side wall.

Also, while the lateral distance between the sidewalls is made smaller in this embodiment, the vertical distance between the sidewalls may equally be made smaller.

Embodiment 4

In this embodiment, the movable contact member and the stationary contact member are provided at their contact sides with electrodes such as arc horns or arc runners and an exhaust port is provided in the direction of the electrode surface at the time of the current interruption.

Figure 13:
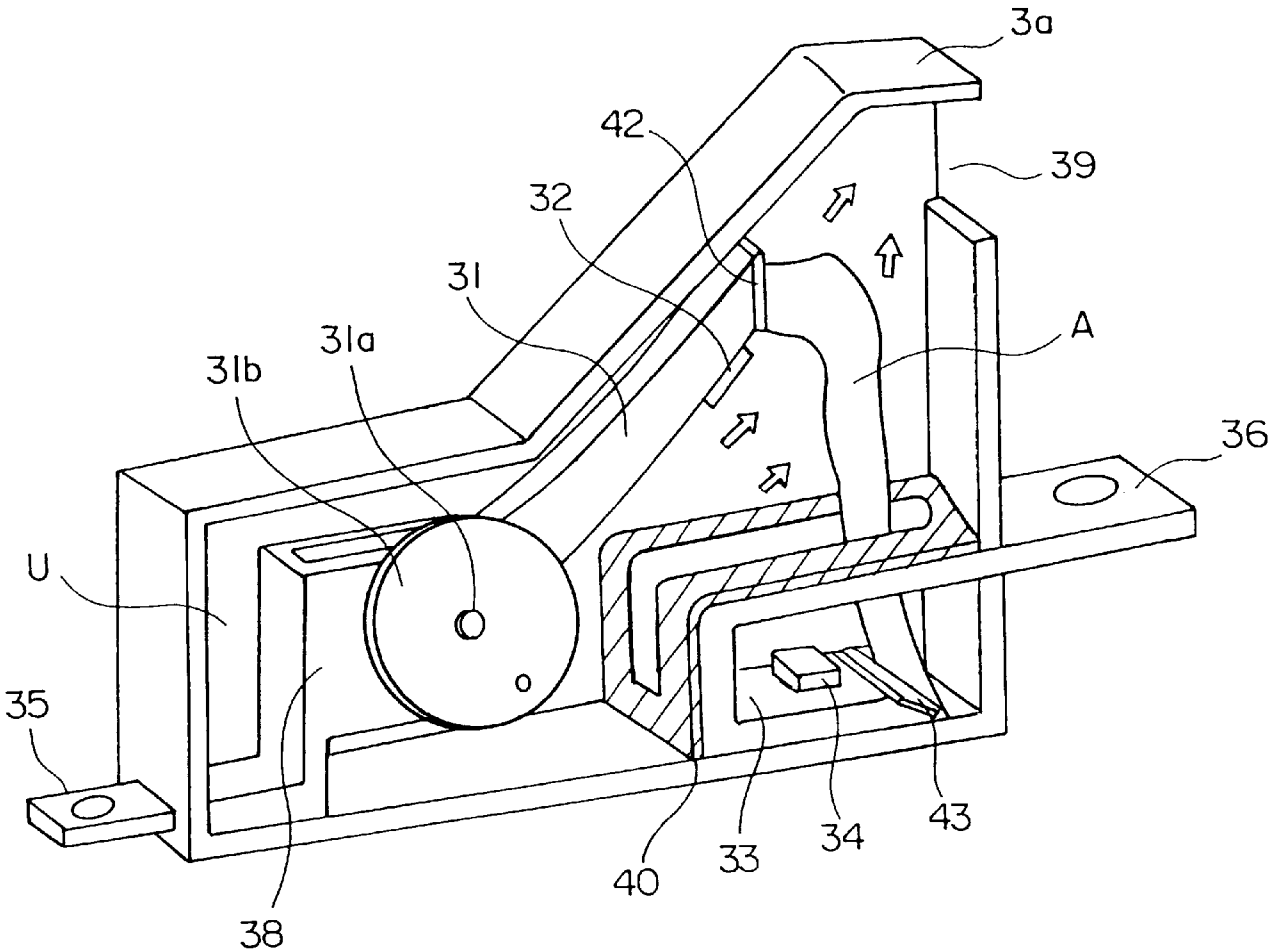
FIG. 13 is a view showing the arc extinguisher unit of the circuit interrupter of the fourth embodiment of the present invention.

FIG. 13 is a view showing the arc extinguisher unit of the circuit breaker of the fourth embodiment, being an exploded perspective view in which the arc extinguisher plates, the arc extinguisher side plates and the arc extinguisher unit housing cover are omitted from illustration. In the figure, 42 is an electrode (hereinafter referred to as arc horn) provided by extending the tip portion of the movable contact member 31, 43 is an electrode (hereinafter referred to as arc runner) provided by extending the tip portion of the stationary contact member 33, and 39 is an exhaust port, which is arranged such that the bottom surface of the arc horn 42 in the open state is directed toward this exhaust port 39. In other respects, the structure is similar to that of the first embodiment, so that their explanation will be omitted.

Generally, although the arc generated between the contacts 32 and 34 upon the current interruption is transferred to the electrodes 42 and 43, during the arc generation, the metallic electrode material is generated as vapor from the interfaces between the arc and the electrodes 42 and 43. It is disadvantageous that such the metallic vapor is contained in the pressurized gas within the pressure accumulating space. However, in this embodiment, as shown in FIG. 13, the arrangement is such that the normal of the surface of the arc horn 42 is directed to the exhaust port 39, so that the metallic vapor generated at the interface between the arc and the arc horn 42 can be easily exhausted from the exhaust port 39 to suppress the degrading of the insulation between the contacts, resulting in a circuit breaker of a superior interrupting capability.

Also, the arc horn is provided by extending the movable contact member and the arc runner is provided by elongating the stationary contact member in this embodiment, they can be equally provided as separate members and similar advantageous results can be obtained.

Also, the exhaust port is at a position opposing to the bottom surface of the arc horn in this embodiment, the exhaust port may also be positioned to oppose to the upper surface of the arc runner.

Embodiment 5

In the fifth embodiment, an organic insulating member is provided in the vicinity of the arc generating position.

Figure 14:
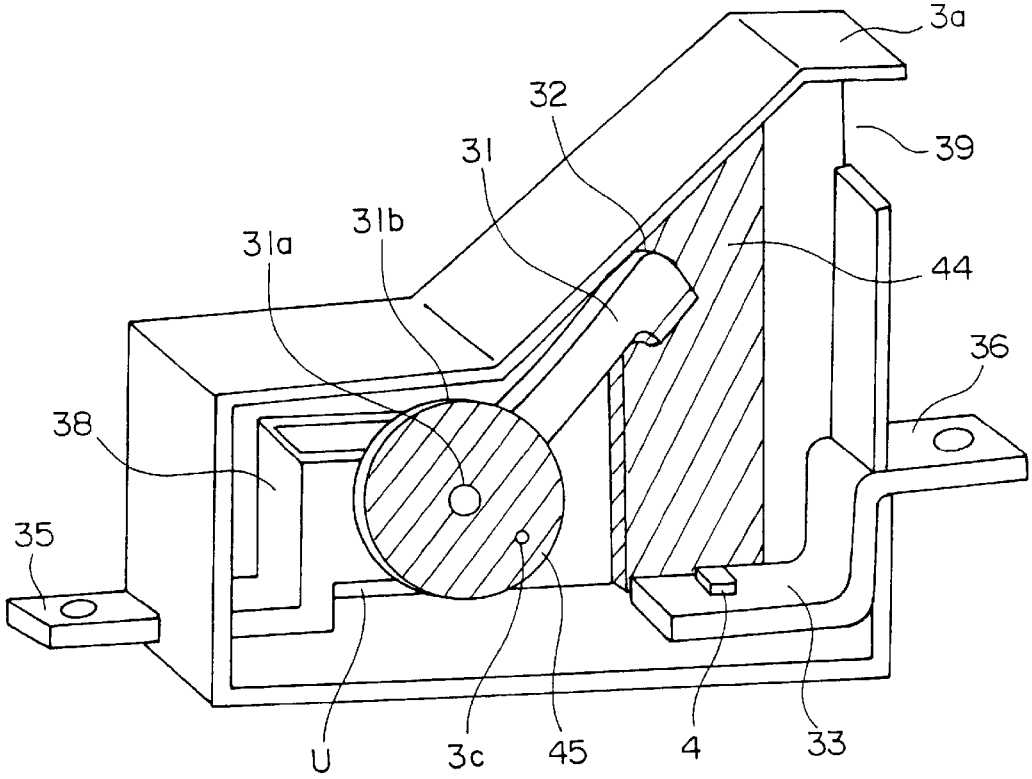
FIG. 14 is a perspective view showing the arc extinguisher unit of the circuit interrupter of the fifth embodiment of the present invention.

FIG. 14 is a view showing the arc extinguisher unit of the circuit breaker of the fifth embodiment of the present invention, which is an exploded perspective view schematically showing the arc extinguisher plates, the arc extinguisher side plates and the arc extinguisher unit housing cover. In the figure, 44 is an organic insulating member disposed in the vicinity of the arc generating position, 45 is an organic insulating member mounted to the rotor 31*b*. In other respects, the structure is similar to that of the first embodiment, so that their explanation will be omitted.

Since the organic material generally decomposes and generates a gas when it is exposed to an electric arc, any organic material may be used as the organic insulating members 44 and 45, but preferably a porous polymer material such as polyacetal which generates relatively large amount of decomposition gas. With such the member, a large amount of decomposition gas is generated upon the exposition to the arc so that the pressure within the arc extinguisher unit 3 can be increased to obtain a massive gas flow, resulting in a circuit breaker having a superior interruption capability.

The gas within the arc extinguisher unit 3 upon the arc generation can be classified into three main groups of metal vapors generated from the contacts and the conductors, organic gases generated from the insulators such as the arc extinguisher unit 3 and air. The metallic vapor, which is a highly electrically conductive gas, is the cause of decreasing the interrupting capability and the remaining two gases which has a relatively low electrical conductivity contribute to the interrupting performance. Therefore, by providing an organic insulating member which generates an organic gas having a high interrupting capability within the arc extinguisher unit 3 as shown in FIG. 14, the gas of organic insulating material of a low electrical conductivity is actively discharged, so that the pressure within the arc extinguisher unit 3 is further increased to enable the strong gas flow to act on the arc and, since the organic gas itself has an interrupting function, the interrupting capability can be further improved.

Also, the configuration or the like of the organic insulating member is not particularly limited and required only to be provided in a position close to the arc generating position.

Also, the insulating member 40 of the stationary contact member 33*a* may be used in common with the gas generating organic member as illustrated in FIG. 8. Particularly, when an organic insulating member is provided in the direction opposite to the exhaust port as viewed from the arc, an ideal gas flow acting on the arc is formed from the organic insulating member which is the pressure generating source toward the exhaust port which is a flow outlet, whereby a circuit breaker of a higher interrupting capability can be obtained. In particular, when the insulating member 40 is disposed on the side of the stationary contact member 33*a* as shown in FIG. 8, the arc extinguishing gas generates immediately after the separation of the movable contact member, the amount of the pressurized gas is increased and the blow is enhanced, whereby a circuit breaker of a higher interrupting capability can be obtained.

Embodiment 6

In general, the arc of a small current value has a small energy and the generated pressure is small. As a result, the flow speed of the gas blasted against the arc is small and sometimes sufficient gas flow cannot be obtained when the pressure accumulating space is excessively large.

In this embodiment, therefore, a small compartment is disposed in the vicinity of the arc generating position in the inner wall surface of the arc extinguisher unit, and this small compartment is used as the pressure accumulating space, so that a sufficiently strong gas flow can be blasted against the arc even when the current value of the arc is small.

Figure 15:
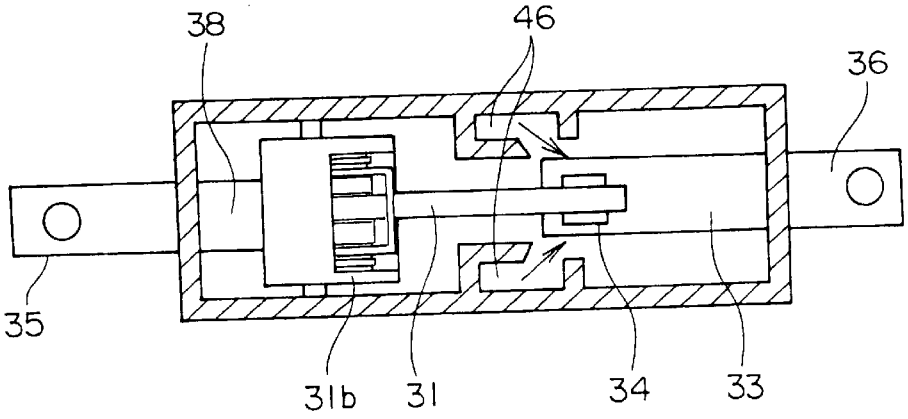
FIG. 15 is a schematic sectional plan view of the arc extinguisher unit of the sixth embodiment of the present invention.
Figure 16A:
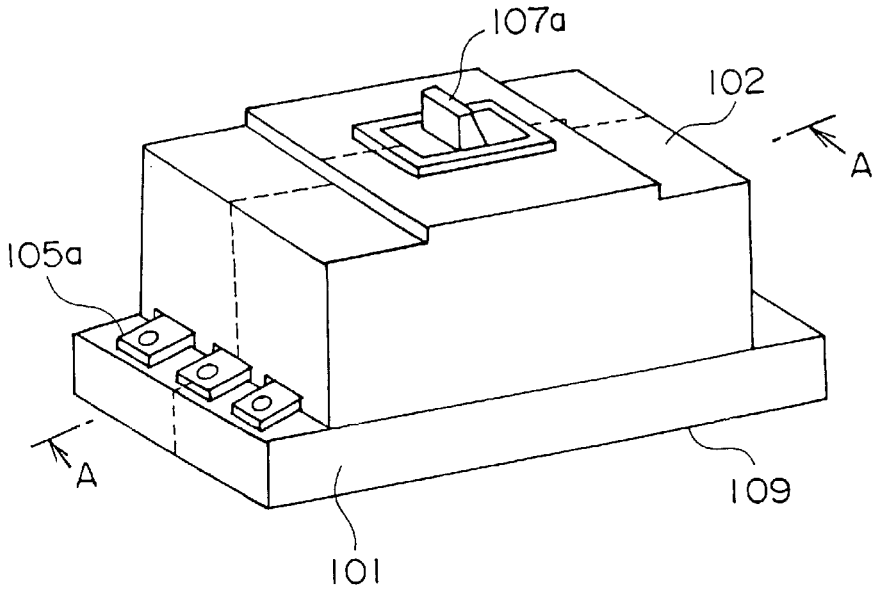
FIG. 16a PRIOR ART
FIG. 16*a* is a perspective view showing the arrangement of a conventional circuit breaker.
Figure 16B:
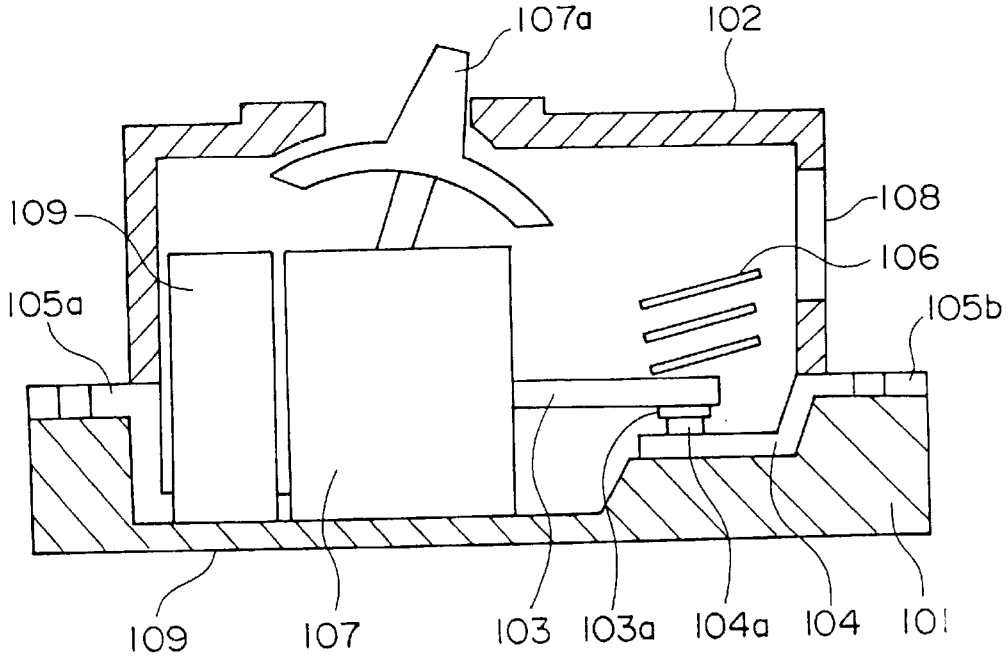
FIG. 16b PRIOR ART
FIG. 16*b* is a schematic sectional side view of the circuit breaker shown in FIG. 16*a*.

FIG. 15 is a sectional top view in which the arc extinguisher unit of the sixth embodiment is viewed from the above. In the figure, 46 are small compartments disposed to the sidewalls of the arc extinguisher unit 3 in the vicinity of the arc generating position. These small compartments 46 which are provided in the vicinity of the arc generating position has an opening portion that opens toward the arc generating position and the portion other than this opening portion is hermetically sealed to define the pressure accumulating space. The opening portion is directed toward the exhaust port so that the pressurized gas blasted from this opening portion may impinge upon the arc.

Thus, by the provision of the small compartments 46, the pressurized gas pressurized upon the arc generation is temporarily stored within the pressure accumulating space defined in the small compartments 46 and, thereafter, the gas flows from the small compartments 46 are blasted against the arc in the direction shown by the arrows in FIG. 15. Since the small compartments 46 have only small volume, a large pressure is generated because the pressure is inversely proportional to the volume and a massive pressure can be generated with a low arc energy when the volume of the small compartments 46 is small.

Also, when a material which generates a large amount of gas by the arc energy is provided to increase the pressure generated within the small compartments, a circuit breaker having a still improved interrupting capability can be obtained.

As has been described, the circuit breaker according to the present invention comprises a stationary contact member having a stationary contact, a movable contact member having at one end a movable contact capable of contacting with and separating from the stationary contact and having at the other end a rotational center, an arc extinguisher chamber vessel surrounding the stationary contact and the movable contact and defining a pressure accumulating space at one side of an arc generation position at which an electric arc is generated for temporarily storing a pressurized gas pressurized by the arc generated between the stationary and the movable contact upon the current interruption, a main body case including at least one of the arc extinguisher chamber, and an exhaust port disposed at the other end of the arc generation position in the arc extinguisher chamber and the main body case so that the pressurized gas stored within the accumulation space upon the current interruption is exhausted between arc spots formed on the stationary contact and the movable contact, so that a massive gas flow can be blasted at the arc until the arc is extinguished, realizing a good interrupting capability.

Also, the arc extinguisher chamber vessel may be constructed in a hexahedron and may have a length c in the direction perpendicular to the plane of rotation of the movable contact, a length b in the direction of initial separation of the movable contact, a length a perpendicular to the b and the c, and may be arranged such that a relation ship a>b>c holds, so that a large pressure accumulating space can be ensured and the pressurized gas can be efficiently blasted at the arc.

Also, of two spaces defined by dividing a space within the arc extinguisher chamber by a plane passing through the centers of the arc spots formed on the movable contact member and the stationary contact member and perpendicular to a plane of rotational movement of the movable contact member, volume of the space provided with the exhaust port may be arranged to be smaller than the volume of the other space, a large pressure accumulating space can be maintained even within a compact arc extinguisher unit.

Also, the exhaust port may be located in the vicinity of the stationary contact or the movable contact upon separation, the flows of the pressurized gas can be made asymmetry within the vessel, allowing the further improvements in the interrupting capability.

Also, a conductor portion for holding the movable contact member may be disposed within the arc extinguisher compartment so that the movable contact member is rotatable and the pressure accumulation space is defined in the vicinity of the conductor portion, the pressurized gas can be blasted at the arc from the lateral direction.

Also, a flow cross-sectional area for the pressurized gas at the position between the stationary contact and the movable contact in a flow path between the stationary contact and the movable contact from the pressure accumulation space may be made smaller than a flow cross-sectional area for the pressurized gas at the position upstream of the flow cross-sectional area between the stationary contact and the movable contact, so that a massive gas flow can be blasted at the arc, further improving the interrupting capability.

Also, a side wall of the arc extinguisher compartment vessel in the vicinity of the arc generating position is provided with a chamber having an opening portion in the direction of the arc, so that a massive gas flow can be blasted at the arc even with a small current arc, providing a good interrupting capability.

Also, the arc extinguisher chamber vessel may be made of an organic insulating material, so that the gas pressure can be increased and the arc interrupting capability can be increased by the pressurized gas of a high interrupting capability.

Also, an organic insulating material may be disposed in the vicinity of the arc generating position within the arc extinguishing chamber vessel, so that the gas pressure can be increased and the arc interrupting capability can be increased by the pressurized gas of a high interrupting capability.

Further, an exhaust port may be provided in the vicinity of at one of the stationary contact or the movable contact upon separation and the organic insulator may be provided in the vicinity of the other of the stationary or movable contact upon separation, so that a uniform gas flow can be generated from the organic insulator which is the gas generating source toward the exhaust port which is an outlet port, providing a good interrupting capability.

Also, an electrode for the commutation of either one of the arc spots may be disposed in the vicinity of the stationary contact of the stationary contact member or the movable contact of the movable contact member, and the direction of normal of the plane to which the arc spot commutates may be more closely directed toward the exhaust port than is the direction of normal of the plane of the contacting surface of the movable contact or the stationary contact, so that the metal vapor generated from the electrodes can be easily exhausted from the exhaust port, improving the interrupting capability.

Also, a fine opening of the arc extinguisher chamber vessel except for the exhaust port may be closed by a separate member engaged thereto, so that the leakage flow of the pressurized gas from the openings other than the exhaust port can be decreased, allowing the pressurized gas to be blasted at the arc with a sufficient intensity and period of time.

INDUSTRIAL APPLICABILITY

This invention relates to a circuit breaker for interrupting and protecting an electric circuit upon the generation of an abnormal current and is useful as protective switchgear for the electric circuit and device.

What is claimed is:

1. A circuit breaker comprising:

a stationary contact member having a stationary contact;

a movable contact member having, at a first end, a movable contact contacting with and separating from said stationary contact, and having, proximate a second end, an axis about which said movable contact member rotates, moving said movable contact toward and away from said stationary contact; and an arc extinguisher chamber vessel including a plurality of walls enclosing said movable contact member and part of said stationary contact member and defining an internal volume of said arc extinguisher chamber vessel, wherein part of said stationary contact member extends through one of said walls that includes an exhaust port for escape of gas from the internal volume of said arc extinguisher chamber vessel, and the internal volume of said arc extinguisher chamber vessel includes a pressure accumulating volume remote from said exhaust port for accumulating gas elevated in temperature and pressure by an arc generated upon separation of said movable contact from said stationary contact and interrupting a current flowing through said movable and stationary contacts so that the gas elevated in temperature and pressure is discharged through the exhaust port, aiding in extinguishing the arc, said pressure accumulating volume having, in a plane including the axis of rotation of said movable contact member, a cross-sectional area smaller than the cross-sectional area of said arc extinguisher chamber vessel in a plane that is parallel to the plane including the axis of rotation of said movable contact member, that passes through centers of said movable contact and said stationary contact, and that is proximate said wall including said exhaust port.

2. The circuit breaker as claimed in claim 1, wherein said exhaust port and the axis of rotation of said movable contact member lie on opposite sides of said movable contact so that gas accumulated in said pressure accumulating volume flows across said movable contact toward said exhaust port for aiding in extinguishing an arc extending between said stationary and movable contacts.

3. The circuit as defined in claim 1, including a conductor rotatingly supporting said movable contact member and within said pressure accumulation volume.

4. The circuit breaker as claimed in claim 1, wherein each of two opposing walls of said arc extinguisher chamber vessel include, within said arc extinguisher chamber vessel, protrusions proximate said stationary contact, spaced from said exhaust port, and transverse to gas flowing from said pressure accumulation volume to said exhaust port, for locally accelerating the gas flowing from said pressure accumulating volume to said exhaust port.

5. The circuit breaker as claimed in claim 1, wherein each of two opposing walls of said arc extinguisher chamber vessel include, within said arc extinguisher chamber vessel, proximate said stationary contact, spaced from said exhaust port, and transverse to flow of gas from said pressure accumulating volume to said exhaust port, a respective chamber having a longitudinal opening oriented toward said stationary contact.

6. The circuit breaker as claimed in claim 1, wherein said arc extinguisher chamber vessel is an organic insulating material.

7. The circuit breaker as claimed in claim 1, including, disposed on interior walls of said arc extinguisher chamber vessel, within said arc extinguisher chamber vessel, proximate said stationary contact, spaced from said exhaust port, and transverse to flow of gas from said pressure accumulating volume to said exhaust port, a strip of an organic insulating material.

* * * * *

UNITED STATES PATENT AND TRADEMARK OFFICE

CERTIFICATE OF CORRECTION

PATENT NO. : 6,573,815 B1
DATED : June 3, 2003
INVENTOR(S) : Tsukima et al.

It is certified that error appears in the above-identified patent and that said Letters Patent is hereby corrected as shown below:

Column 14,
Line 31, replace claim 1 with:

1. A circuit breaker comprising:

a stationary contact member having a stationary contact;

a movable contact member having, at a first end, a movable contact contacting with and separating from said stationary contact, having, proximate a second end, an axis about which said movable contact member rotates, moving said movable contact toward and away from said stationary contact; and an arc extinguisher chamber vessel including a plurality of walls enclosing said movable contact member and part of said stationary contact member and defining an internal volume of said arc extinguisher chamber vessel, wherein part of said stationary contact member extends through one of said walls that includes an exhaust port for escape of gas from the internal volume of said arc extinguisher chamber vessel, the internal volume of said arc extinguisher chamber vessel includes a pressure accumulating volume remote from said exhaust port for accumulating gas elevated in temperature and pressure by an arc generated upon separation of said movable contact from said stationary contact and interrupting a current flowing through said movable and stationary contacts so that the gas elevated in temperature and pressure is discharged through the exhaust port, aiding in extinguishing the arc, said pressure accumulating volume having, in a plane including the axis of rotation of said movable contact member, a cross-sectional area smaller than the cross-sectional area of said arc extinguisher chamber vessel in a plane that is parallel to the plane including the axis of rotation of said movable contact member, that passes through centers of said movable contact and said stationary contact, and that is proximate said wall including said exhaust port, and said arc extinguisher chamber vessel has, in a cross-section transverse to the axis of rotation of said movable contact member, a hexagonal shape with a width $c$ extending in a direction perpendicular to a plane in which said movable contact rotates in moving toward and away from said stationary contact, a height $b$ extending in a direction of initial movement of said movable contact separating from said stationary contact, a length $a$ extending in a direction perpendicular to the width and the height, and $a>b>c$.

Signed and Sealed this

Fifteenth Day of November, 2005

JON W. DUDAS
*Director of the United States Patent and Trademark Office*